United States Patent [19]

StLawrence

[11] 4,454,968

[45] Jun. 19, 1984

[54] APPARATUS FOR WINDING FILAMENTS

[76] Inventor: John J. StLawrence, 99 Leighton St., Lynn, Mass. 01904

[21] Appl. No.: 318,006

[22] Filed: Nov. 4, 1981

Related U.S. Application Data

[63] Continuation-in-part of Ser. No. 263,672, May 14, 1981, abandoned.

[51] Int. Cl.[3] ..... A41H 43/00

[52] U.S. Cl. ..... 223/46

[58] Field of Search ..... 223/46; 28/147; 289/1.2, 1.5

[56] References Cited

U.S. PATENT DOCUMENTS

| | | | |
|---|---|---|---|
| 2,521,863 | 9/1952 | Mertz | 223/46 |
| 2,763,080 | 9/1956 | Welch | 28/147 X |
| 3,044,670 | 7/1962 | Barefoot | 28/147 X |
| 3,223,440 | 12/1965 | Rosenzweig | 223/46 X |
| 3,286,888 | 11/1966 | Cuttler et al. | 223/46 |
| 3,428,227 | 2/1969 | Cavoli | 223/46 |
| 3,816,888 | 6/1974 | Rather | 28/147 |

*Primary Examiner*—Louis Rimrodt

*Attorney, Agent, or Firm*—Thomas C. Stover, Jr.

[57] ABSTRACT

The method and apparatus are disclosed for winding ribbon or yarn around rows of upstanding spindles spaced a desired distance apart. The ribbon or yarn is wound around the spindles in a desired pattern of loops and secured between the spaced rows of spindles by typing with a wire.

One of the rows of spindles is moved toward the other to slacken the loops, the wire is further tightened if necessary and the winding is removed to produce a uniform, multi-looped bow of ribbon and/or yarn.

Extender spindles are also provided which mount adjacent the above spindles and extend the effective height thereof for winding additional rows of ribbon or yarn and/or wider ribbon.

9 Claims, 8 Drawing Figures

APPARATUS FOR WINDING FILAMENTS

The following is a continuation-in-part of my copending application, Ser. No. 06/263,672, filed May 14, 1981, now abandoned, and having the same title.

BACKGROUND OF THE INVENTION

1. Field of the Invention

This invention relates to method and apparatus for winding a filament, particularly a method and apparatus for winding a filament in a desired configuration.

2. The Prior Art

There is a wide market for wound filaments including ribbon wrapped in bows for e.g. packages, floral pieces and corsages. Several devices have been constructed to assist the winding of filament e.g. yarn or ribbon into a uniform winding of bows or other patterns. For example, U.S. Pat. No. 2,542,222 to A. Welch (1951), provides a bow-tying apparatus in which one loop of ribbon at a time, is wound around a pair of spaced horizontal arms 40, shown in FIGS. 1 and 2, a central portion of the winding is impaled on a pin 22, shown in FIGS. 1 and 2 and the next segment of ribbon is wound or looped around the horizontal arms 40, which pushes the prior-wound loop off the arms 40. The next so-wound loop of ribbon is impaled at a center portion thereof over the prior ribbon winding, and the cycle is repeated until a rosette of ribbon bows, as shown in FIG. 4 of the Welch reference, is formed. Accordingly, such apparatus requires the steps of winding one ribbon loop at a time, impaling a center portion of such loop and forming, impaling and stacking successive loops of ribbon in such multi-step process for forming such rosette.

U.S. Pat. No. 3,816,888 to J. Rather (1974) discloses a pair of spaced rods 9 and 10 around which yard is wound in a stacked series of windings, as shown in FIG. 1, which are subsequently joined at the center thereof and subsequently slipped off the rods 9 and 10 to form a pompon, as shown in FIG. 4 thereof. This apparatus permits but a vertical stack of windings, so that in winding ribbon, one would obtain edge-to-edge loops rather than side-by-side loops, which can be compactly secured together.

U.S. Pat. No. 3,044,670 to Barefoot (1962) discloses a ribbon winder wherein upstanding pegs are arranged in a base around a central peg or hub and the ribbon is wound back and forth around the outer pegs and impaled at a central portion thereof on such hub to provide a compact package bow. Again, such apparatus teaches a ribbon piercing or impaling step, as each ribbon loop is formed. Further, such apparatus forms a flat or compact package bow and not a flowing bow-winding e.g. for a floral piece.

Accordingly, the above-cited prior art does not provide a method and apparatus for a free-flowing winding of a filament, including ribbon and there is a need and market for a method and apparatus for winding filament that substantially overcomes the above prior art shortcomings.

There has now been discovered a method and apparatus for winding filament including ribbon, in a free-flowing manner, wherein such filament can be rapidly wound in a multi-loop pattern to a desired size and readily securing such winding.

SUMMARY

Broadly, the present invention provides a ribbon winder comprising, a base which has a plurality of upstanding spindles mounted on such base. A plurality of such spindles are moveably mounted on such base so that the distance between a plurality of the spindles is adjustable.

In one embodiment, the height of the spindles can be extended to wind more ribbons or ribbons of greater width therearound.

Means are provided to secure the moveable spindles in place at a desired location on the base for winding a filament therearound.

The invention further provides a method for winding a filament comprising, adjusting a plurality of spaced spindles a desired distance apart and winding the filament around such spindles in a desired pattern. The so-wound pattern is secured and at least some of the spindles are moved toward each other to slacken the so-wound pattern to permit its ready removal.

BRIEF DESCRIPTION OF THE DRAWINGS

The invention will become more apparent from the following detained specification and drawings in which.

DETAILED DESCRIPTION OF THE DRAWINGS

Figure 1:
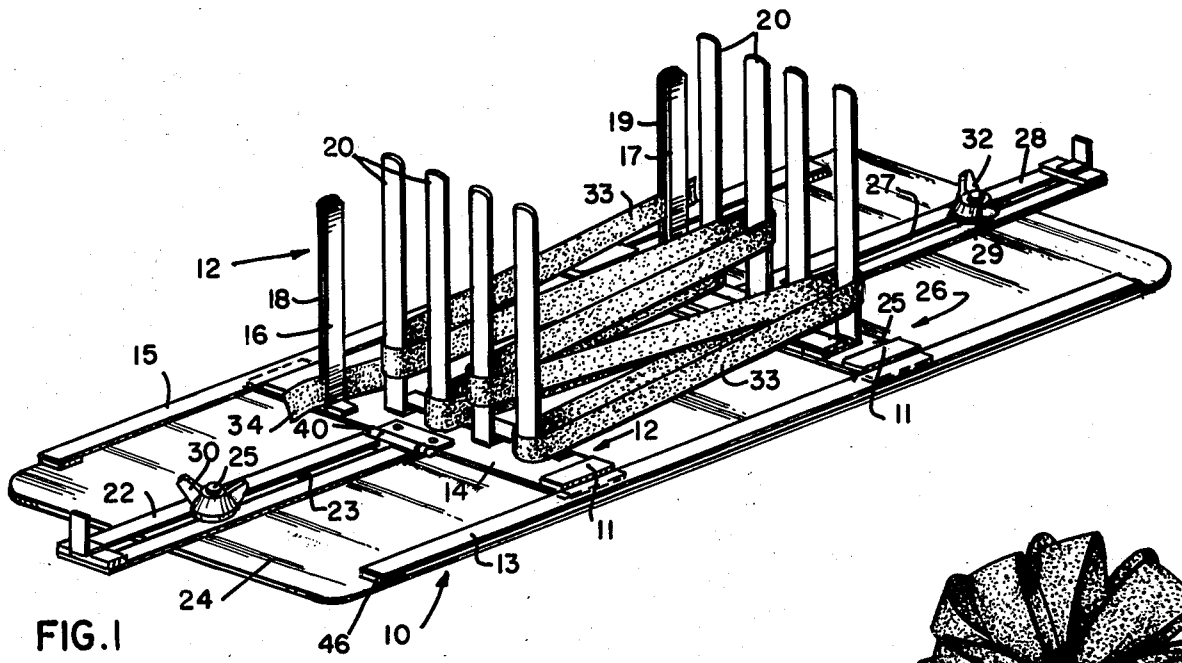
FIG. 1 is a perspective view of the filament winder embodying the present invention.
Figure 2:
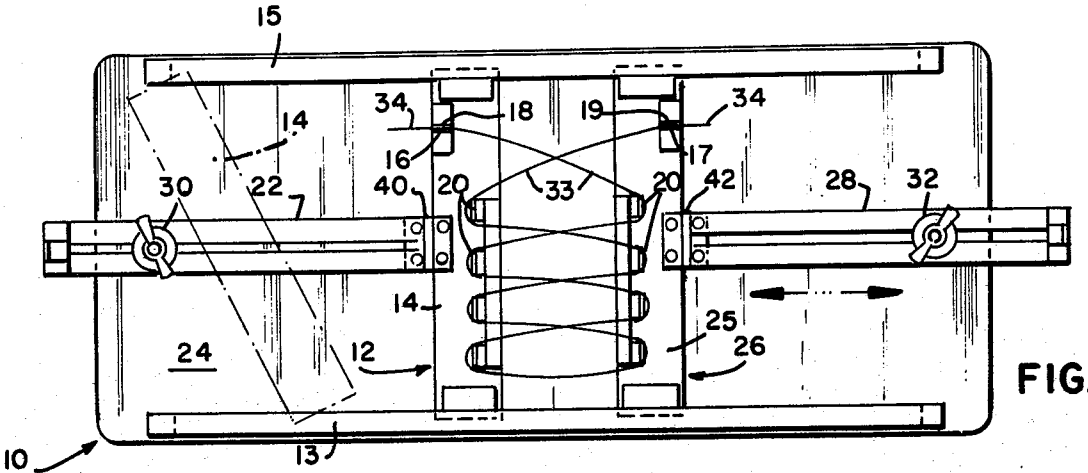
FIG. 2 is a plan view of the filament winder shown in FIG. 1.
Figure 3:
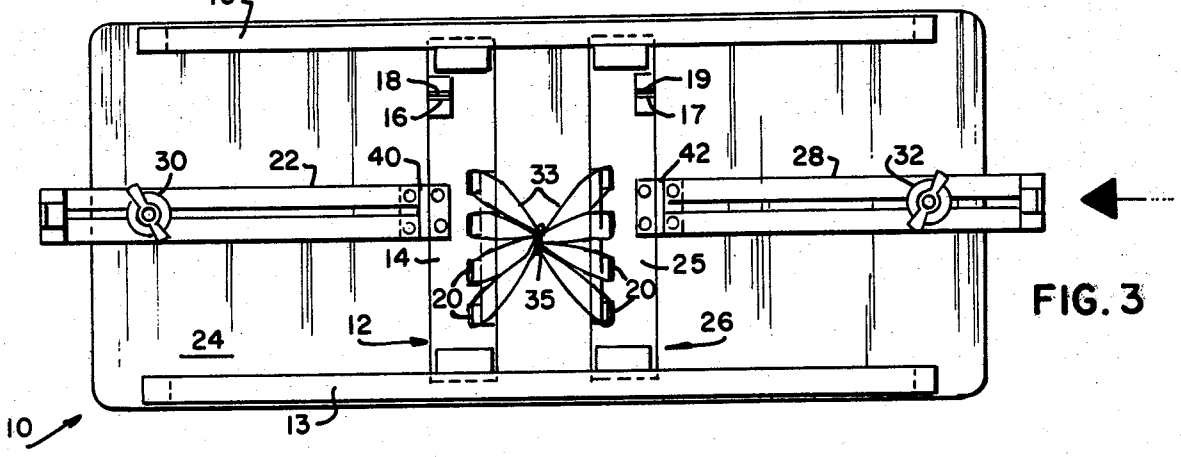
FIG. 3 is a further plan view of the filament winder similar to that shown in FIG. 2

Referring in more detail to the drawings, the filament winder 10 includes spindle assembly 12 having base 14, a pair of closely spaced double spindles 16 and 18 and spaced single spindles 20, is shown in FIG. 1. The base 14 extends into edge channels 13 and 15 of the support tray 24 so that the spindle assembly 12 is slideable lengthwise of the tray 24, as shown or indicated in FIG. 1. Opposed spindle assembly 26 has a pair of closely spaced double spindles 19 and 17 and several spaced single spindles 20 which are mounted to base 25, as shown in FIG. 1. The base 25 extends under the edge channels 13 and 15 of the support tray 24 and the spindle assembly 26 is longitudinally slideable on such channel toward and away from the opposed spindle assembly 12 as indicated in FIGS. 1, 2 and 3. The spindle assembly base 12 has mounted thereto an arm 22, having a longitudinal slot 23 therein of sufficient width to allow the arm 22 and the spindle assembly 12 to slide back and forth with clearance around such threaded member 25, as shown in FIG. 1. A wing nut 30 fits around the threaded member 25 is threaded engagement therewith, which wing nut 30 is tightened to secure the arm 22 and the spindle assembly 12 in the desired location on the support tray 24, as shown or indicated in FIGS. 1, 2 and 3. Similarly, the spindle assembly 26 has mounted thereto arm 28 having a longitudinal slot 27 therein, which fits over a threaded member 29 having mounted thereover wing nut 32 in threaded engagement therewith, which likewise is tightened to secure the arm 28 and the spindle assembly 26 in a desired position on the support tray 24, as shown or indicated in FIGS. 1, 2 and 3.

The base 14 can readily be turned diagonally and slipped under or out from under the edge channels 13 and 15 of the support tray 24 as indicated in phantom in FIG. 2. The base 25 can likewise be installed or removed from such edge channels 13 and 15. Blocks 11, mounted respectively on the bases 14 and 25, as shown in FIG. 1, prevent sideslip of such bases relative to the edge channels 13 and 14 and maintain the combs 12 and 26 in alignment in the support tray 24 as shown in FIGS. 1, 2 and 3.

In operation, the spindle assemblies or combs 12 and 26 are positioned a desired distance apart on the support tray 24 and the respective wing nuts 30 and 32 are tightened to secure such combs in place. Then a ribbon 33 is wound as follows; the end 34 of the ribbon 33 is passed between pronged pair 16 and 18, shown in FIGS. 1 and 2 to secure same and the remainder of the ribbon is wound back and forth around the opposed spaced spindles 20 to obtain a plurality of windings, as shown in FIGS. 1 and 2.

Advantageously, but not necessarily, the ribbon 33 is wound around sufficient of the spaced spindles 20 so that it returns to the opposite pair of closely spaced spindles 17 and 19 to secure the other end of the ribbon e.g., as indicated in FIGS. 1 and 2.

Advantageously, one of the wing nuts can be loosened and one of the combs e.g. comb 26 moved slightly away from the opposed comb 12 to take up any slack in the respective ribbon windings. Then a bow-securing member, such as a wire 35, is wrapped around the respective ribbon loops to draw and secure the same together at a desired point between the loops thereof, as shown in FIG. 3. At this stage, the so-secured ribbon loops are under tension and an attempt to remove the so-wound ribbon or bow from the spindles of the combs 12 and 26 could cause tears in at least some of the ribbon loops in contact with the respective spindles 20.

Figure 4:
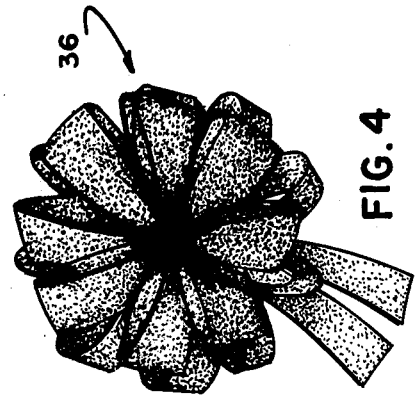
FIG. 4 is a perspective view of a ribbon winding, wound according to the present invention.

Accordingly in one of the important features of the present invention, a wing nut is loosened and e.g. comb is advanced slightly (e.g. ½ inch) toward the comb 12 to slacken the ribbon windings between such combs after which the wire 35 is further tightened if necessary, to further secure such windings together and the so-formed bow is easily removed from the spindles of the combs 12 and 16. The so-formed bow is then fluffed out e.g. manually and the trailing ribbon ends 34 trimmed as desired, to provide a decorative, muti-looped bow 36, as shown in FIG. 4.

Further because of the relative movement feature of the combs 12 and 26 of the bow winder embodying the invention, such combs can be spaced and secured various distances apart so that filament windings including bows of various sizes can be wound as desired.

As indicated above, various filaments are wound on the filament winder embodying the invention e.g. ribbon, yarn, cord or any other windable material or a combination thereof can be wound thereon within the scope of the present invention.

More than one filament can be wound on the filament winder embodying the invention at the same time; e.g. ribbons of different colors can be wound on the filament winder embodying the invention to provide a multi-colored bow if desired. In another example a segment of yarn and a segment of ribbon can be wound on the filament winder of the invention to provide a multi-textured bow, if desired.

The filament winder embodying the invention has a plurality of upstanding spindles, at least one of which spindles moves relative thereto. Preferably, a plurality of such spindles Moves relative to one or more, preferably a plurality of other spindles according to the invention. Even more preferred is an assembly or comb of a plurality of upstanding spindles which moves relative to another such assembly or comb in the filament winder embodying the present invention.

Advantageously the closely spaced double spindles e.g. spindles 16 and 18 and/or 17 and 19 are employed with the single spaced spindles e.g. spindles 20 shown in FIG. 1. Such double spindles, while desireable, can be dispensed with if desired, within the scope of the present invention.

One or both of the above-described combs can move on the support tray relative to each other and preferably both of such combs of spindles so move according to the invention.

One or more of the above-described combs can move on the support tray in any manner, e.g. by sliding or where the bases of the combs are mounted on wheels or rollers, by rolling. Preferably, however, the combs of spindles move on the support tray by sliding either in a track, e.g. between edge channels 13 and 15, shown in FIG. 1 or without such edge channels if desired, within the scope of the present invention. The comb arms e.g. arms 22 and 28, shown in FIG. 1, are desirably secured to position the comb spindles 20 as desired, as previously discussed. Such comb arms can be secured by wing nuts which rotate on mating threaded members e.g. as shown in FIG. 1 or such comb arms can be secured by other means e.g. by clamping means or other suitable means as desired within the scope of the present invention.

Figure 5:
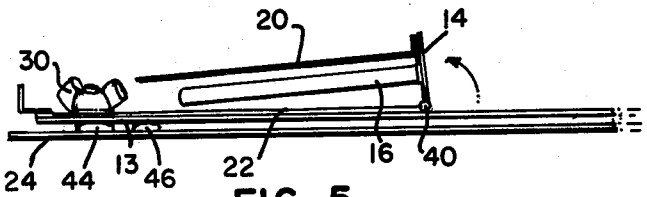
FIG. 5 is an elevation view of the filament winder shown in FIG. 1.

A further important feature of the invention is that the arms can be hingeably joined to the spindle assemblies or combs for compact storage or shipping of the filament winder embodying the invention. Accordingly, comb arm 22 is joined to base 14 by hinge 40 and comb arm 28 is joined to base 25 by hinge 42 as shown or indicated in FIGS. 1, 2 and 3. For example, the wing nut 30 is removed from the threaded member 25 and the comb arm 22 is lifted off such member 25. The base 14 is turned diagonally and removed from under the edge channels 13 and 15, as indicated in phantom in FIG. 2. The comb arm 22 is then repositioned over the threaded member 25, the wing nut 30 is replaced on such member 25 to secure the comb arm 22. Then as previously discussed the base 14 is pivoted on the hinge 40 to lower the respective spindles e.g. spindles 16 and 20, for compact storage, as shown in FIG. 5.

The components of the bow winder of the invention can be made of plastic, wood, metal or other materials and preferably are made of metal e.g. stainless steel or durable plastic as desired, within the scope of the invention.

Accordingly it can be seen that the bow-winder of the invention provides method and apparatus for winding various filaments including ribbon and yarn rapidly into uniform decorative windings of various sizes using one or more filaments to obtain windings including bows for e.g. centerpieces, floral pieces, corsages and the like.

The bow-securing member can be any suitable filament e.g. ribbon, yarn, string, wire and the like and preferably wire.

EXTENDER SPINDLES

Figure 6:
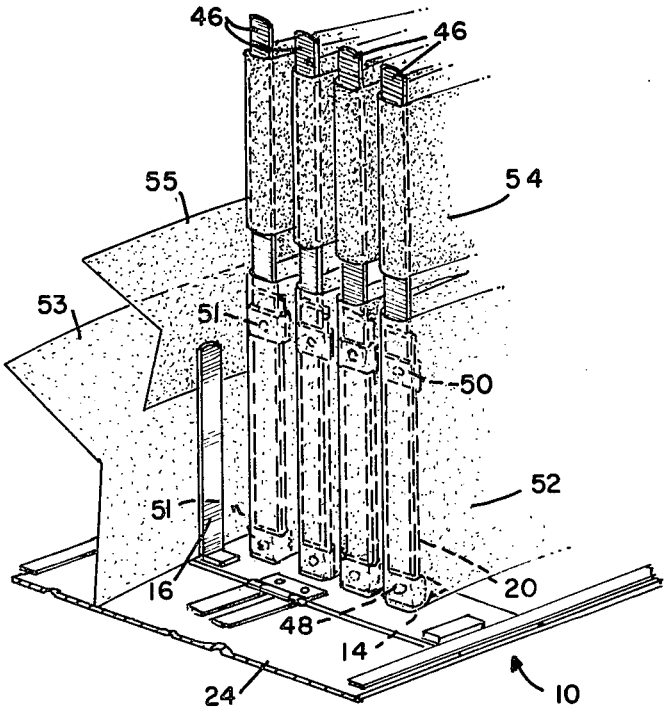
Figure 7:
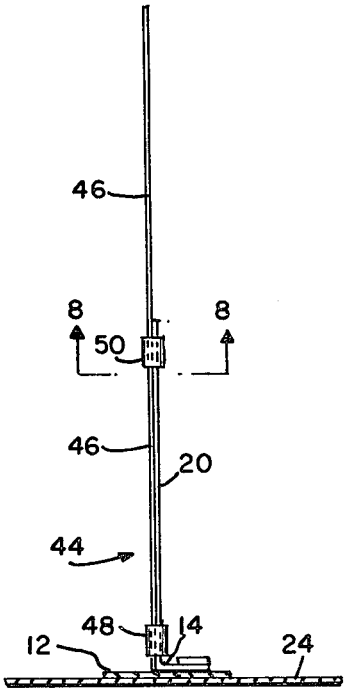
Figure 8:
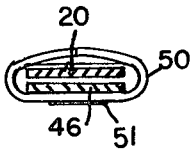

FIG. 6 is a perspective view of another embodiment of the filament winder of the present invention;

FIG. 7 is an elevation view of a component of the embodiment shown in FIG. 6 and FIG. 8 is a cross-sectional view of the component of FIG. 7, taken on lines 8—8, looking in the direction of the arrows.

In another embodiment extender spindles 46 having a pair of belts 48 and 50 welded thereto (at weld spots 51) are slipped over the ends of the shorter spindles 20, as shown in FIGS. 6, 7, & 8. The elongated spindle assembly 44 permits the winding on the filament winder 10 of extra wide ribbons such as ribbon 52 having an end 53, which ribbon is wider than the height of the base spindle 20, as shown in FIG. 6 and permits the winding of additional ribbons above the wide ribbon 52 such as ribbon 54, which terminates in an end 55, also as shown in FIG. 6.

Although extender spindles can be provided for the double spindles, eg. double spindles 16 and 18 if desired, such double spindles 16 and 18 can function without such spindle extenders, eg. as shown in FIG. 6.

Accordingly the spindle extenders of the invention provide a means to convert the filament winder of the invention from a winder for small or regular size ribbons, eg. as shown in FIG. 1, to a winder for a high stack of such ribbons or one or more greater width ribbons, eg. as shown in FIG. 6, by quickly and easily sliding the respective extender spindles 46 and their belts 50 over the shorter spindles 20, as discussed above. Such extender spindles 46 can, as readily, be removed from the shorter spindles 20 to convert the filament winder 10 back to its regular configuration, eg. as shown in FIG. 1. Alternatively, the extender spindle 46 can be placed over one or more of the shorter spindles 20, as discussed above, to provide a combination spindle assembly having tall and short spindles thereon, as desired within the scope of the invention. Further, such extender spindles can be of different lenghts as desired, within the scope of the present invention.

Like the spindles 20, the spindle extenders can be made of metal, plastic or wood and preferably are of metal or plastic.

What is claimed is:

1. A filament winder comprising, a support member and at least two rows of upstanding spindles thereon, at least one of said rows of spindles being mounted on a moveable base, guide means to channel movement of said base and its spindles on said support member and clamping means for securing said base and its spindles in a desired position on said support member and means to secure said other row of spindles for winding a filament thereon.

2. The winder of claim 1 wherein each of said rows is slideably mounted on said base.

3. The winder of claim 2 wherein at least one of said rows has a plurality of spaced spindles therein and at least two spindles mounted in close proximity to secure an end of said filament.

4. The winder of claim 2 wherein each of said rows of spindles is hingeably mounted to pivot from an upstanding position to a position proximate said base.

5. The winder of claim 4 wherein each of said rows is hingeably mounted to an arm.

6. The winder of claim 1 wherein at least one extender spindle is mounted adjacent one of said spindles to extend the height thereof.

7. The winder of claim 6 wherein a plurality of extender spindles are mounted adjacent a like number of said spindles to extend the height thereof.

8. The extender spindle of claim 6, having at least one belt member mounted thereto which fits over and around said spindle to hold said extender spindle adjacent to said spindle.

9. The extender spindle of claim 8 having a plurality of belt members mounted thereto which fit over and around said spindle.

* * * * *